US009908749B2

(12) United States Patent
Lob et al.

(10) Patent No.: US 9,908,749 B2
(45) Date of Patent: Mar. 6, 2018

(54) BLOCK

(75) Inventors: Charles J. Lob, Oconomowoc, WI (US); Kenneth E. Lange, Brookfield, WI (US)

(73) Assignee: Harken, Inc., Pewaukee, WI (US)

( * ) Notice: Subject to any disclaimer, the term of this patent is extended or adjusted under 35 U.S.C. 154(b) by 0 days.

(21) Appl. No.: 13/296,210

(22) Filed: Nov. 14, 2011

(65) Prior Publication Data

US 2012/0292583 A1 Nov. 22, 2012

Related U.S. Application Data

(60) Provisional application No. 61/413,370, filed on Nov. 12, 2010.

(51) Int. Cl.
*B66D 3/04* (2006.01)
*B66C 3/04* (2006.01)

(52) U.S. Cl.
CPC ..... *B66C 3/04* (2013.01)

(58) Field of Classification Search
CPC ..... B66D 3/04
USPC ..... 254/400–409, 412
See application file for complete search history.

(56) References Cited

U.S. PATENT DOCUMENTS

| | | | | | |
|---|---|---|---|---|---|
| 142,095 | A | * | 8/1873 | Ford | 254/409 |
| 275,916 | A | * | 4/1883 | Jackson | 254/412 |
| 360,989 | A | * | 4/1887 | Betteley | 254/412 |
| 1,359,904 | A | * | 11/1920 | Mallory | 254/412 |
| 2,210,202 | A | * | 8/1940 | Duda | 254/403 |
| 2,269,768 | A | * | 1/1942 | Keeney | 254/405 |
| 2,396,790 | A | * | 3/1946 | Jensen | 403/209 |
| 2,502,570 | A | * | 4/1950 | Johnson | 254/402 |
| 2,511,729 | A | * | 6/1950 | Maier | 254/401 |
| 3,250,516 | A | * | 5/1966 | Silberger | 254/409 |
| 3,337,188 | A | * | 8/1967 | Manson | 254/412 |
| 3,528,645 | A | * | 9/1970 | Harken | 254/412 |
| 3,773,295 | A | * | 11/1973 | Holmes | 254/409 |
| 3,899,158 | A | * | 8/1975 | Johnson | 254/405 |
| 4,977,795 | A | * | 12/1990 | McVey | B66D 5/34 188/69 |
| 5,368,281 | A | * | 11/1994 | Skyba | B60P 7/083 254/217 |
| 5,449,154 | A | * | 9/1995 | Lob | 254/394 |
| 5,485,800 | A | * | 1/1996 | Lob | 114/204 |
| 5,489,254 | A | * | 2/1996 | Lob | 384/454 |
| 5,511,447 | A | * | 4/1996 | Galloway | B63H 9/10 192/46 |
| 5,538,224 | A | * | 7/1996 | Powell | B66D 3/04 254/406 |

(Continued)

FOREIGN PATENT DOCUMENTS

GB 172753 12/1921

OTHER PUBLICATIONS

International Search Report issued for PCT/US2011/060669; dated Jun. 28, 2012.

*Primary Examiner* — Michael E Gallion
(74) *Attorney, Agent, or Firm* — Brian G. Gilpin; Godfrey & Kahn, S.C.

(57) ABSTRACT

A block including first and second generally identical side plates that engage one another and rotatably capture a sheave between them. The side plates may includes interlocking tabs to secure the engagement between the side plates or a separate clip may be used to engage elements of the side plates to secure the plates to each other.

9 Claims, 4 Drawing Sheets

(56) References Cited

U.S. PATENT DOCUMENTS

| | | | | |
|---|---|---|---|---|
| 5,845,894 | A * | 12/1998 | Petzl et al. | 254/391 |
| 6,305,669 | B1 * | 10/2001 | Harken et al. | 254/412 |
| 6,651,962 | B2 * | 11/2003 | Habberstad | 254/406 |
| 6,684,805 | B2 * | 2/2004 | Curchod | B29C 70/46 114/108 |
| 6,974,125 | B2 * | 12/2005 | Renton | B63B 21/04 254/409 |
| 7,419,138 | B1 * | 9/2008 | Mauthner | B66D 3/08 254/391 |
| 7,445,195 | B1 * | 11/2008 | Huang | B66D 1/7415 254/223 |
| 7,537,199 | B1 * | 5/2009 | Anderson | B66D 3/02 254/223 |
| 7,562,862 | B1 * | 7/2009 | Jackson | B66D 5/32 254/333 |
| 7,594,642 | B2 | 9/2009 | Curchod | |
| 7,673,851 | B2 * | 3/2010 | Lange | B63H 9/10 254/401 |
| 7,988,132 | B2 * | 8/2011 | Lange | 254/409 |
| 8,002,244 | B2 * | 8/2011 | Curchod | B63H 9/08 254/390 |
| 8,210,502 | B2 * | 7/2012 | Fogg | E21B 33/072 254/406 |
| 8,733,739 | B2 * | 5/2014 | Mauthner | A62B 1/14 254/391 |
| 9,187,298 | B2 * | 11/2015 | DeSoo | B66D 3/04 |
| 2003/0111655 | A1 * | 6/2003 | Habberstad | 254/415 |
| 2005/0173688 | A1 * | 8/2005 | Smith | 254/405 |
| 2005/0263748 | A1 * | 12/2005 | Smith | 254/409 |
| 2005/0274936 | A1 * | 12/2005 | Lutter et al. | 254/398 |

* cited by examiner

BLOCK

CROSS-REFERENCE TO RELATED APPLICATION

The present application claims priority to earlier filed U.S. Provisional Application Ser. No. 61/413,370, filed on Nov. 12, 2010, the disclosure of which is incorporated herein by reference in its entirety.

BACKGROUND

Improvements to existing blocks for use in sailing or other applications are desirable to achieve some or all of the following: reduce the cost of construction, reduce the part count; eliminate or reduce separate fasteners needed to assemble a block, and improve overall strength of the block. These do not represent the entire list advantages that may be achieved or which may be desirable to be achieved by an improved block.

The present disclosure relates to an approach to the design, construction and assembly of blocks that may address some or all of the above goals, in addition to achieving other improvements that may be apparent to those having skill in the related art.

BRIEF DESCRIPTION OF THE DRAWINGS

The accompanying drawing figures, which are incorporated in and constitute a part of the description, illustrate several aspects of the invention and together with the description, serve to explain the principles of the invention. A brief description of the figures is as follows.

DESCRIPTION

Figure 1:
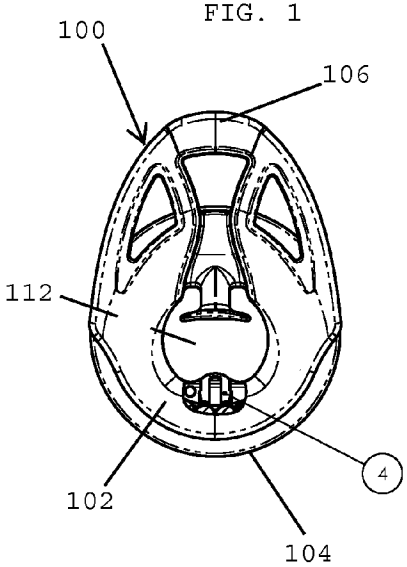
FIG. 1 is a first side view of a block according to the present disclosure, with a portion of the block removed to illustrate the positioning of a clip to secure the side plates to the block.
Figure 2:
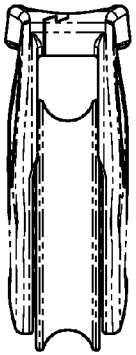
FIG. 2 is an edge view of the block of FIG. 1.
Figure 3:
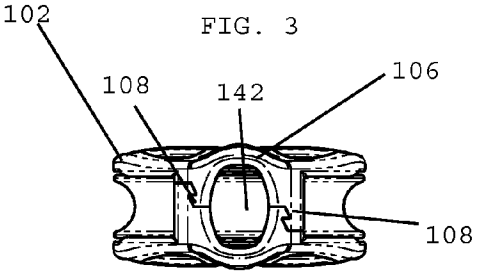
FIG. 3 is a top view of the block of FIG. 1.
Figure 4:
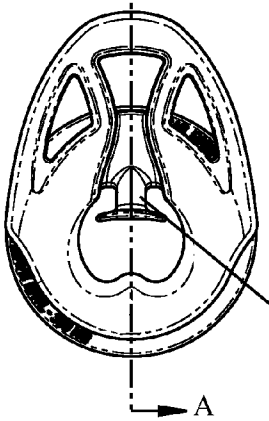
FIG. 4 is a second side view of the block of FIG. 2.
Figure 6:
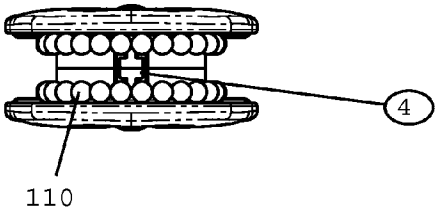
FIG. 6 is a bottom view of the block of FIG. 1 with the sheave removed for clarity.
Figure 5:
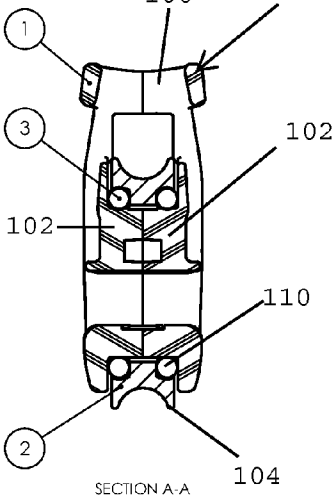
FIG. 5 is a cross-sectional view of the block of FIG. 1 taken along line A-A of FIG. 4.

Reference will now be made in detail to exemplary aspects of the present invention which are illustrated in the accompanying drawings. Wherever possible, the same reference numbers will be used throughout the drawings to refer to the same or like parts.

FIGS. 1 to 7 illustrate an improved block 100, preferably for use on sailboats but adaptable for use in other applications and settings. Block 100 may include a pair of generally identical side plates 102 with a sheave 104 rotatably mounted between the side plates. At a top 106 of the side plates 102 are a pair of interlocking tabs 108 that are configured to releasably secure the side plates 102 to each other. As numbered in FIG. 7, and as shown in FIGS. 2, 3, 7-10, and 13, each of the tabs 108 include interlocking fingers 47 receivable in recesses 37. When the finger 47 of one tab on one side plate is received in the recess of an opposed tab on the other side plate, the tabs interlock, thereby securely holding the side plates to each other. Within an opening 112 of side plates 102 about which sheave 104 rotates is positioned a clip indicated by number 4 within a circle. Clip 4 is configured to interact with and cooperate with a tab 130 of the side plates 102 to secure the bottom of the side plates to each other. Clip 4 may preferably be inserted within grooves or recesses 132 on either side of tabs 130. Clip 4 is preferably inserted into engagement with tabs 130 from within opening 112 and pressed downward into grooves 132.

Opening 112 is preferably configured to receive a line or other flexible securing member to secure block 100 to a sailboat or some other surface or device. A post 140 may be positioned within opening 112 to permit a bight or loop of line passing through an opening 142 adjacent top 106 and into opening 112. A second bight or loop of line may be passed through opening 142 and into opening 112 from an opposite side and secured about post 140.

Sheave 104 may be preferably mounted to the side plates on top of ball bearing 110 to permit smooth rotation. Other types of bearings may be used within the scope of the present disclosure, such as but not limited to roller, needle, bushing, hybrid, etc.

Figure 7:
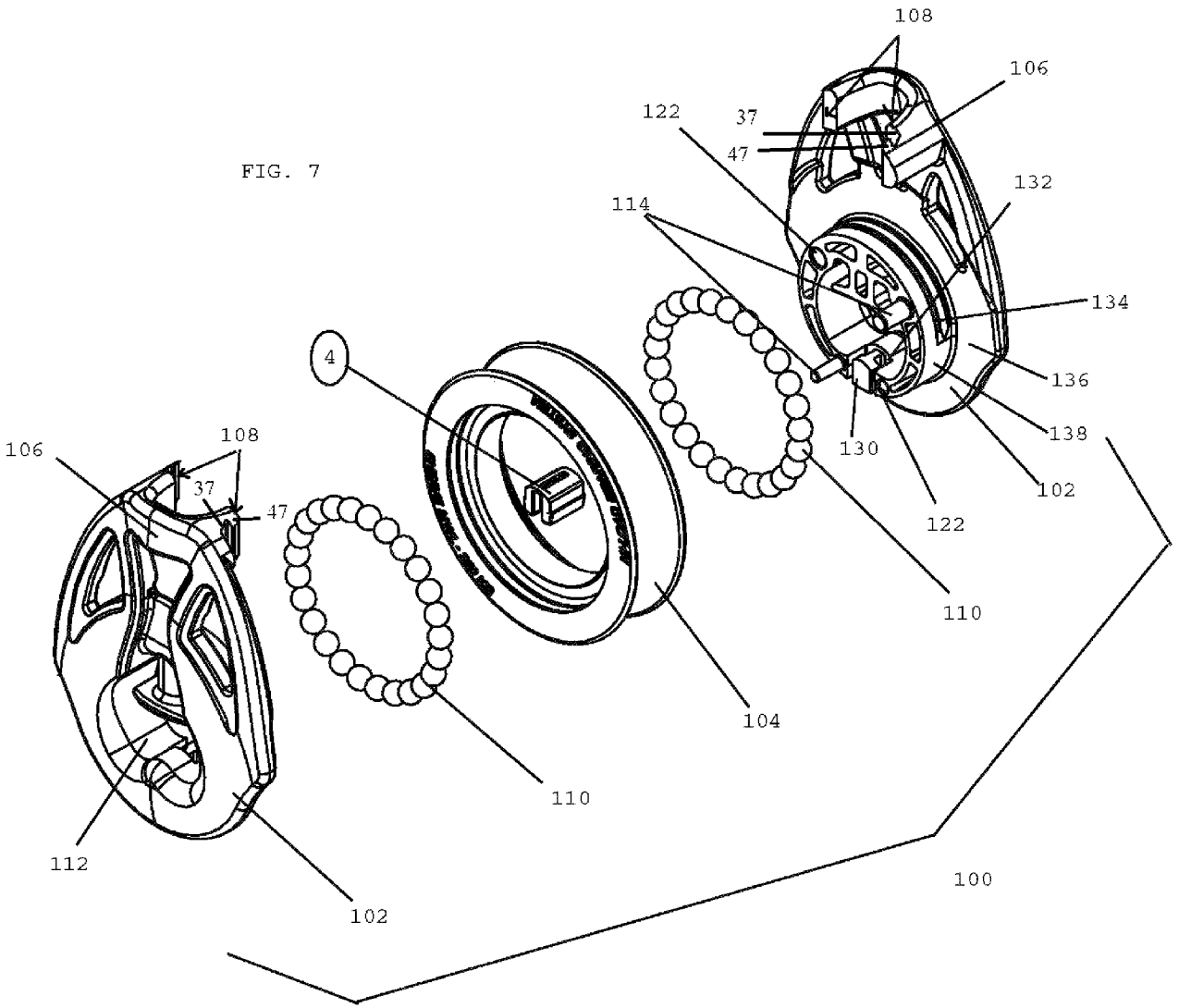
FIG. 7 is an exploded perspective view of the block of FIG. 1.
Figure 8:
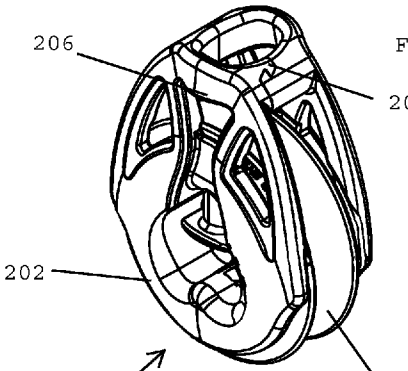
FIG. 8 is a perspective view of a second embodiment of a block according to the present disclosure.
Figure 9:
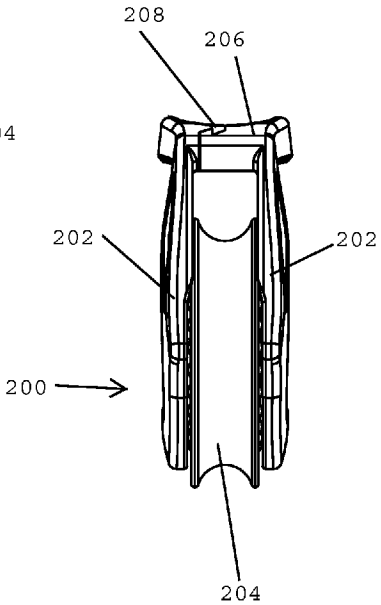
FIG. 9 is an edge view of the block of FIG. 8.
Figure 10:
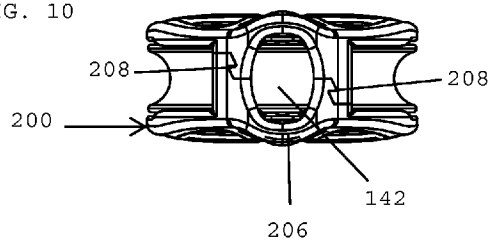
FIG. 10 is a top view of the block of FIG. 8.
Figure 11:
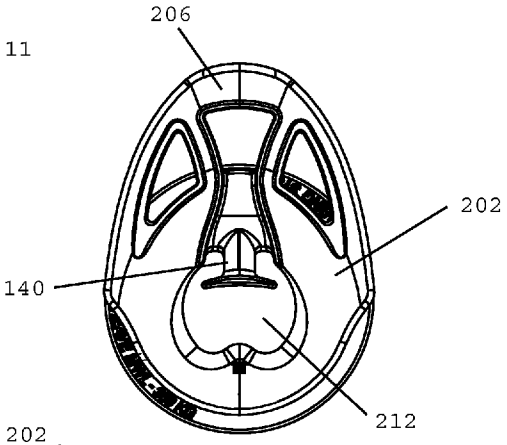
FIG. 11 is a side view of the block of FIG. 8.
Figure 12:
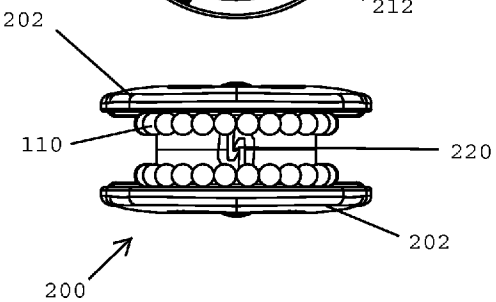
FIG. 12 is a bottom view of the block of FIG. 8 with the sheave removed for clarity.

As shown in FIG. 7, the interior surfaces of side plates 102 may include additional engaging features such as but not limited to pins 114 that may be configured and positioned to engage openings 122 to ensure proper relative orientation and positioning of the side plates. These engaging features may also provide added structural integrity to the assembly block 100. It is anticipated that no additional engaging features may be needed for some configurations or embodiments of blocks according to the present disclosure. It is further anticipated that the pins and openings may have integral interlocking elements to further secure the side plates to each other. It is also anticipated that the interlocking features may be combined with the engaging features.

Side plate 102 may include a bearing track 134 within a portion of sheave receiving space 136, with the bearing track 134 positioned toward top 106 along an inner wall 138. Since the primary loads placed on a rope or line running through sheave 104 will come from opposite top 106, the highest loading about the circumference of the sheave will be adjacent bearing track 134. Bearing track 134 will ensure that bearings 110 remain in a preferred alignment between sheave 104 and side plate 102. Bearing tracks 134 may also include some reinforcement or strengthening materials to aid in the resisting of these loads placed on the sheave and improve wear resistance.

FIGS. 8 to 13 illustrate a block 200 according to the present disclosure which does not require any additional clear such as clip 4, described above with regard to block 100) beyond a pair of preferably identical side plates 202 to secure the block assembly. A sheave 204 may be mounted between the side plates 202 with an opening 212 in the side plates extending through a center of the sheave. Adjacent a top 206 of each side plate 202 of block 200 is a first interlocking tab 208. Tabs 208 from the pair of side plates 202 of block 200 engage each other and cooperate to releasably secure the assembly of the side plates about the sheave. At a bottom of each side plate 202 opposite top 206 is a second interlocking tab 220. Tabs 220 from the pair of side plates 202 of block 200 engage each other and cooperate to releasably secure the assembly of the side plates about the sheave.

Figure 13:
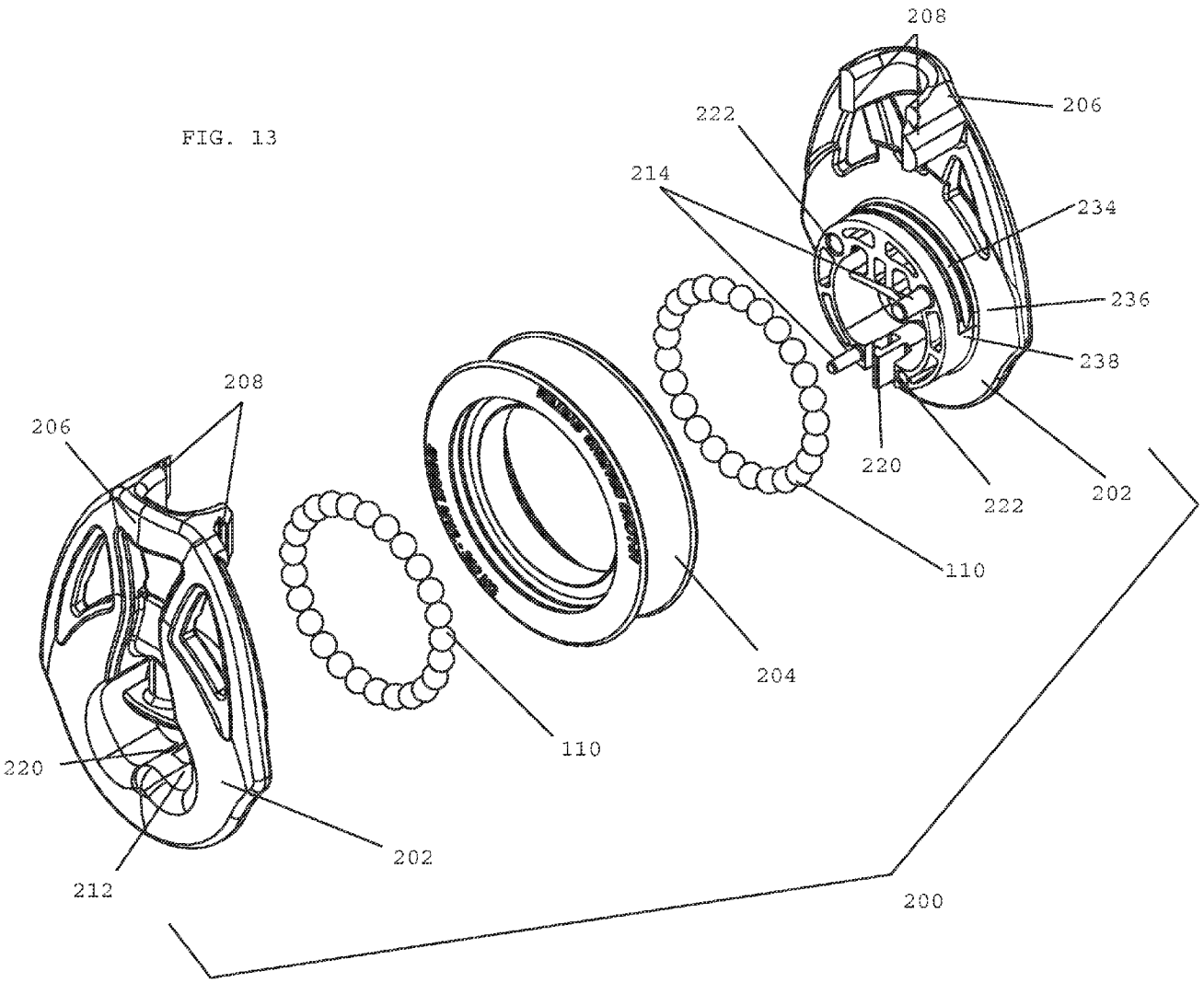
FIG. 13 is an exploded perspective view of the block of FIG. 8.

As shown in FIG. 13, the interior surfaces of side plates 202 may include additional engaging features such as but not limited to pins 214 that may be configured and positioned to engage openings 222 to ensure proper relative orientation and positioning of the side plates. These engaging features may also provide added structural integrity to the assembly block 200. It is anticipated that no additional engaging features may be needed for some configurations or embodiments of blocks according to the present disclosure. It is further anticipated that the pins and openings may have integral interlocking elements to further secure the side plates to each other. It is also anticipated that the interlocking features may be combined with the engaging features.

Side plate 202 may include a bearing track 234 within a portion of sheave receiving space 236, with the bearing track 234 positioned toward top 206 along an inner wall 238. Since the primary loads placed on a rope or line running through sheave 204 will come from opposite top 206, the highest loading about the circumference of the sheave will be adjacent bearing track 234. Bearing track 234 will ensure that bearings 110 remain in a preferred alignment between sheave 204 and side plate 202. Bearing tracks 234 may also include some reinforcement or strengthening materials to aid in the resisting of these loads placed on the sheave and improve wear resistance.

When assembled as shown herein, both block 100 and 200 are configured so that the engagement or interlocking of the tabs or the pins and corresponding openings will prevent the side plates from rotating with respect to each other and retain the sheave and any supporting bearings between the side plates.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A block comprising:

first and second side plates, the first and second side plates each having a top and a bottom, at least one of the first and second side plates having a bearing track on an inside portion thereof;

a plurality of bearings positioned around and on the bearing track;

an axle-less sheave rotatably mounted between the first and second side plates over and in direct contact with the plurality of bearings; and a first tab formed integral with and adjacent the top of the first side plate and a second tab formed integral with and adjacent the top of the second side plate, the first tab from the first side plate and the second tab from the second side plate both being configured with interlocking fingers and recesses to securely hold the first and second side plates together with the sheave therebetween when the first tab from the first side plate and the second tab from the second side plate are engaged wherein each of the first and second side plates further comprise a pin extending toward the other side plate and engaging a corresponding opening in the other side plate; a first element on the first side plate and a second element on the second side plate forming the recesses, and a clip inserted into engagement with the first element and the second element to be inserted within the recesses such that the first plate and the second plate are held together.

2. The block of claim 1, wherein the clip is positioned over the second tabs from within an opening in the first and second side plates within the axle-less sheave.

3. The block of claim 1, wherein the first and second side plates cooperate to define an opening through the block extending within the axle-less sheave, the opening configured to receive lines to secure the block.

4. A block comprising:

a first side plate with an integrally formed connecting element with an interlocking finger and recess adjacent a top of the first side plate;

a second side plate with an integrally formed complementary connecting element with an interlocking finger and recess adjacent a top of the second side plate;

at least one of the first side plate and the second side plate having a bearing track on an inside portion thereof;

wherein when the integrally formed connecting element, interlocking finger, and recess of the first side plate and the integrally formed complementary connecting element, interlocking finger, and recess of the second side plate are engaged, the first side plate and second side plate are secured together; and an axle-less sheave held between the first side plate and the second side plate when the integrally formed connecting element of the first side plate and the integrally formed complementary connecting element of the second side plate are secured together, the sheave positioned over and in direct contact with a plurality of bearings positioned between the axle-less sheave and the bearing track a clip with a first end and a second end; a first recess formed in the first side plate adjacent a bottom of the first side plate and a second recess formed in the second side plate adjacent a bottom of the second side plate; and wherein the first end of the clip is inserted into the first recess of the first side plate and the second end of the clip is inserted into the second recess of the second side plate such that the first side plate and second side plate may be selectively engaged.

5. The block of claim 4, further comprising:

a second integrally formed connecting element adjacent a bottom of the first side plate;

a second integrally formed complementary connecting element adjacent a bottom of the second side plate; and wherein the first side plate and second side plate may be selectively engaged and secured together when the integrally formed second connecting element of the first side plate and the integrally formed second complementary connecting element of the second side plate are engaged.

6. The block of claim 4, further comprising a post connected to one of the first side plate or second side plate.

7. The block of claim 4, further comprising a first post connected to the first side plate and a second post connected to the second side plate.

8. The block of claim 6, wherein the post is integrally formed with one of the first side plate or second side plate.

9. The block of claim 4, wherein the first side plate may be unsecured from the second side plate without the use of a tool.

* * * * *